United States Patent [19]

Mason

[11] 4,286,488

[45] Sep. 1, 1981

[54] DISPENSING APPARATUS FOR ROLLED SHEET MATERIAL

[75] Inventor: Joseph E. Mason, Melville, N.Y.

[73] Assignee: American Can Company, Greenwich, Conn.

[21] Appl. No.: 112,794

[22] Filed: Jan. 16, 1980

[51] Int. Cl.[3] ..... B26D 5/20

[52] U.S. Cl. ..... 83/205; 83/277; 83/545; 83/597; 83/649; 225/53

[58] Field of Search ..... 83/202, 203, 205, 249, 83/259, 276, 277, 478, 524, 544, 545, 597, 648, 649, 614, DIG. 1; 225/14, 15, 16, 53, 90; 242/55.2, 55.3, 55.53

[56] References Cited

U.S. PATENT DOCUMENTS

| | | | |
|---|---|---|---|
| 1,076,635 | 10/1913 | Howard | 242/55.53 |
| 1,092,909 | 4/1914 | H ardy | 225/53 X |
| 2,274,977 | 3/1942 | Currier | 83/614 X |
| 2,450,496 | 10/1948 | Whileley | 83/614 |
| 2,761,450 | 9/1956 | Sandy | 83/545 X |
| 2,889,975 | 6/1959 | Hanlon | 242/55.53 X |
| 3,028,060 | 4/1962 | Haley | 225/53 |
| 3,035,345 | 5/1962 | Barnard | 83/649 X |
| 3,050,853 | 8/1962 | Domeny | 83/649 X |
| 3,104,847 | 9/1963 | Miller | 242/55.3 X |
| 3,625,100 | 12/1971 | Barnard | 83/205 |
| 3,971,280 | 7/1976 | Inka | 83/649 X |

*Primary Examiner*—Frank T. Yost
*Assistant Examiner*—Robert P. Olszewski
*Attorney, Agent, or Firm*—Robert P. Auber; George P. Ziehmer; Harry W. Hargis, III

[57] ABSTRACT

Apparatus for dispensing and selectively cutting lengths of plastic film from a roll. A box-shaped container has side, front, rear, and bottom walls, and a cover hinged adjacent the rear wall. The cover affords access to the container, so that a packaged roll of film may be placed inside with its axis extending between and perpendicular to the side walls. The container has side spacers that normally receive a 4-inch width roll package, and a narrower, 2-inch width roll package may be received for which there are provided extensions for the spacers. The spacers slightly compress the package to provide drag on the roll as it becomes lighter. Disposition of the roll package is such that film may be removed from the upper region of the roll, through a slotted opening between the front wall and the adjacent free edge of the closed cover. A pivotal feeder for the film includes a flexible and resilient arm mounted on the bottom wall and biased toward the roll, and a flat top portion engaging the lower side of the film. An opening in the cover is in registry with the flat top portion of the feeder, so that, using the finger to press the film down on the flat top portion, the film and feeder may be moved forward in unison to urge the film through the slot. Release of the film and the feeder permits the latter to spring back to retracted position. The desired length of film may then be pulled out and cut from the roll by a provided cutting blade.

11 Claims, 4 Drawing Figures

DISPENSING APPARATUS FOR ROLLED SHEET MATERIAL

BACKGROUND OF THE INVENTION

This invention relates to improvements in dispensing apparatus for elongate strips for sheet material, and particularly to such apparatus that includes means for selectively feeding and cutting desired lengths of sheet material such as plastic film and the like in roll form.

A plastic film for which the invention particularly contemplates improved dispensing means comprises a flexible wax-rubber film composition interwound with paper. While the film is non-tacky, it is not slid readily across a surface. In the dispensing of such a film it has been found desirable to provide means for feeding the film from a roll, and a retractible cutting blade for severing the desired length of film.

The following U.S. patents are representative of the prior art, and are believed material to the examination of this application:

U.S. Pat. No. 2,889,975, in FIGS. 22 to 24, discloses a wall having a slot 80 through which a cutting edge 83 is moved to cut a tape section 79.

U.S. Pat. Nos. 2,274,977 and 2,450,496 disclose web dispensers including razor blades for cutting desired lengths of web.

U.S. Pat. No. 1,092,909 discloses a dispenser having an opening through which a user exerts finger pressure to dispense tape.

U.S. Pat. No. 1,076,635, in FIG. 2, discloses fillers or springs between sides of a tape dispensing container and a tape roll accomodating differences in widths between rolls and the container.

U.S. Pat. No. 3,104,847, in FIGS. 10 to 13, discloses adjustable means accommodating mounting of spools of different widths in a film supply magazine.

None of the references is concerned with a dispenser for a wax-rubber film composition having a non-tacky surface that resists sliding to the extent that it is difficult to dispense.

It is an objective of the invention to provide an improved dispensing apparatus for a roll of sheet material comprising a wax-rubber composition interwound with paper.

It is another objective of the invention to provide an improved combination dispenser-cutter apparatus for plastic sheet material.

It is a further objective of the invention to provide an improved sheet-material feeder in a dispenser-cutter apparatus.

SUMMARY OF THE INVENTION

In achievement of the foregoing as well as other objectives, the invention contemplates a dispensing apparatus for a roll package of sheet material, comprising: a container having side, front, rear and bottom walls, and a removable cover; means for supporting a roll of sheet material in said container with its axis extending between said side walls; spacers between said roll and said side walls compressing said roll to provide a drag thereon as it is unrolled; said sheet material having a free end extending through an opening provided between said front wall and said cover; a pivotal arm for said sheet material mounted on said bottom wall and biased toward said roll, said arm including a flat top portion engaging the lower surface of said film; means defining an opening in said cover, in registry with said flat top portion whereby force applied to urge said sheet material against said flat top portion, and the latter toward said forward opening, pivots said arm away from said roll and moves said sheet material through said forward opening, release of said force permitting said arm to pivot rearwardly against said roll; and means for severing the extended portion of said sheet material.

The manner in which the foregoing as well as other objectives may best be achieved will be more fully understood from the following description, taken in light of the accompanying drawing.

DESCRIPTION OF THE PREFERRED EMBODIMENT

Figure 1:
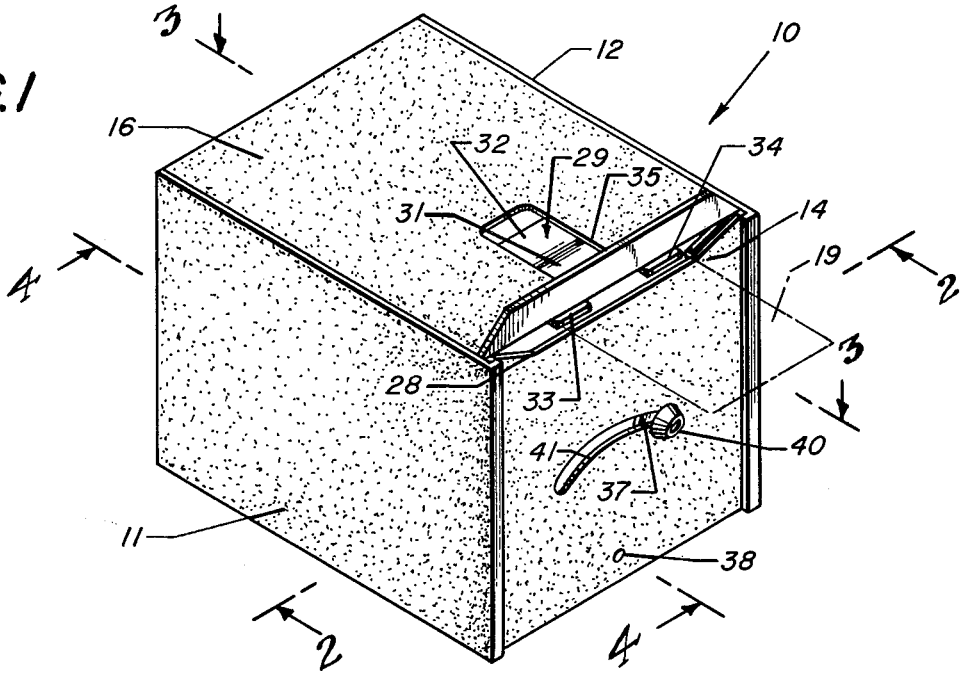
FIG. 1 is a perspective showing of dispenser-cutter apparatus embodying the invention.
Figure 2:
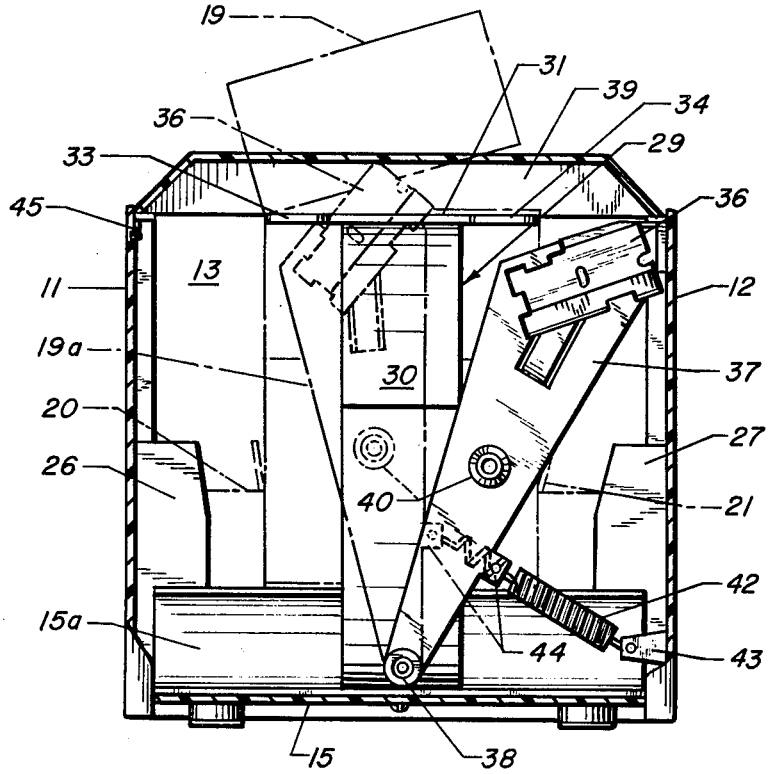
FIG. 2 is an elevational view, partly in section, taken along the line 2—2 in FIG. 1, and looking in the direction of arrows applied thereto.

With more detailed reference to FIGS. 1 to 4 of the drawing, apparatus embodying the invention comprises a box-shaped container 10 having side walls 11 and 12, a rear wall 13, a front wall 14, and a bottom wall 15.

A removable cover 16 is hingedly mounted at 17 and 18 (FIG. 3 only) adjacent rear wall 13, on upper rear corners of the side walls 11 and 12, respectively, for pivotal movements about an axis essentially in the plane of the rear wall 13. Detent means designated generally by the numeral 45 latches cover 16 in its illustrated closed position.

Figure 3:
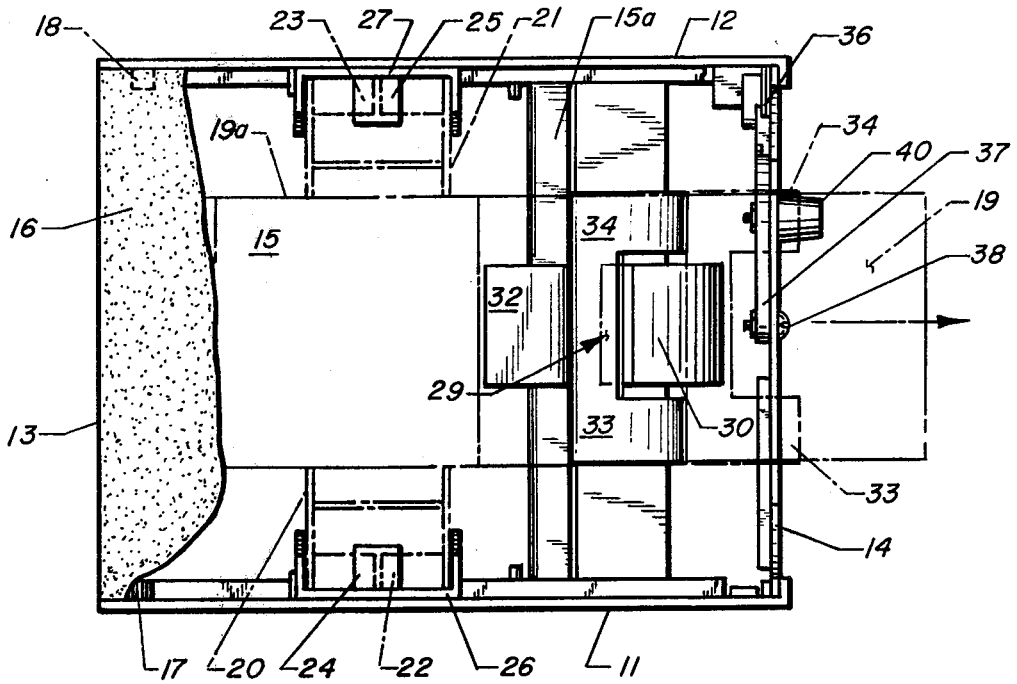
FIG. 3 is a view looking downwardly in the direction of arrows 3—3 in FIG. 1, with portions of the apparatus fragmented for purpose of illustration.
Figure 4:
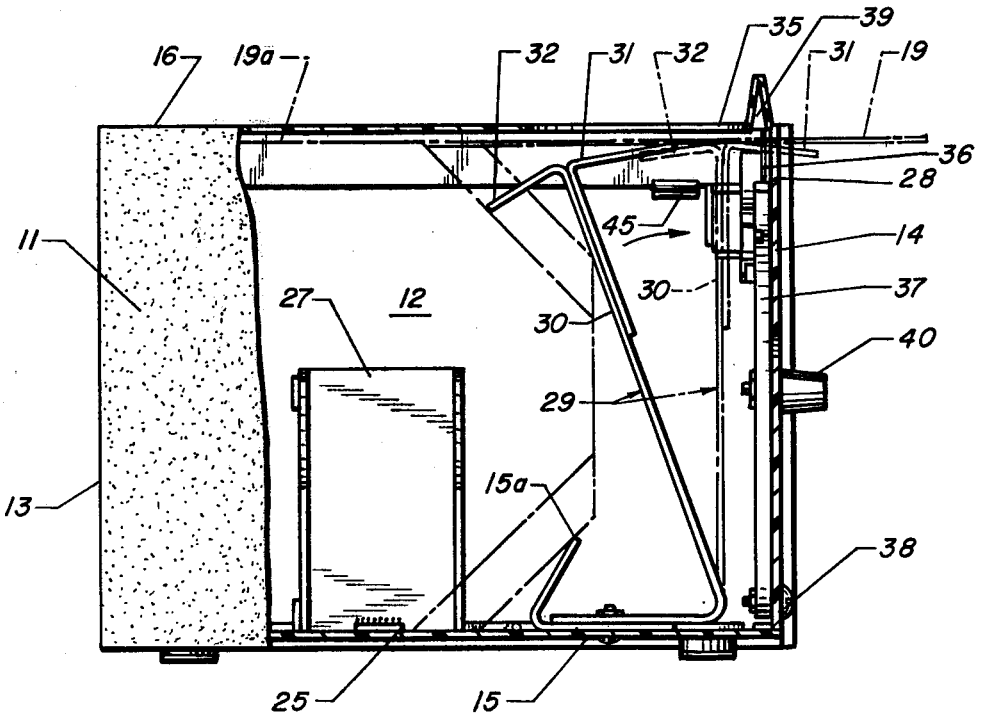
FIG. 4 is a view, partly in section, taken along the line 4—4 in FIG. 1, and looking in the direction of arrows applied thereto.

Bottom wall 15 includes an angular flange **15*a* (FIGS. 2 to 4) that extends between side walls 11 and 12, and with rear wall 13 forms a pocket for receiving a roll of sheet material or film 19 in its package 19*a*, both of which are shown in broken lines throughout the drawing, for convenience of illustration. The axis of the roll of film 19 extends between and is perpendicular to side walls 11, 12. The width of package 19*a* is less than the width of container 10, and removable spacers 20 and 21, as shown in broken lines in FIGS. 2 and 3 only, are wedged between the side walls and the sides of the package. Spacers 20 and 21 conveniently are held in place by adhesive pads on bottoms of the spacers at 22, 23 and on confronting parts of the bottom wall 15 as seen at 24, 25 (FIGS. 3 and 4). A preferred material for pads 22 to 25 is available under the trademark VELCRO. By way of example, package 19*a* holds two-inch width film, and by removing spacers 20 and 21, as is the case in FIG. 4, the container will receive and store a package of four-inch width film (not shown) between permanent projections 26, 27 on side walls 11 and 12, respectively. In any event, spacers 20, 21, or projections 26, 27 exert pressure on the sides of a roll sufficient to produce a slight drag on the film as it unwinds from the roll upon dispensing. This is particularly helpful in preventing dislodgement of the roll package 19*a* as the roll becomes lighter upon progressive removal of film 19, through use. While the roll-package 19*a* may take a number of forms, it as been found convenient to house the film in a hexagonally shaped paperboard carton, as shown in broken lines, and having a suitable top opening (not shown) from which film 19 is fed. Further to the combination, there is provided a slot or opening 28 (FIGS. 1 and 4) between the upper portion of the front wall 14 and the adjacent free edge portion of cover 16 in its closed position, through which the film 19** is threaded for removal or feed from the roll.

In particular accordance with the invention, a pivotal feeder 29 for the film includes a flexible and resilient arm 30 mounted on bottom wall 15 and biased toward the roll package 19*a* in its retracted position; and an upper surface portion such as flat top portion 31 that engages the lower side of film 19. The flat top portion 31 includes a rearward projection 32 that, in a retracted rest position of feeder 29 (FIG. 4, full lines), engages the roll package which serves as a stop, and a pair of laterally spaced forward projections 33, 34 movable, in a film feeding mode (FIG. 1 and FIG. 4, broken lines), through the film dispensing slot 28. An opening 35 is provided in cover 16 (FIGS. 1 and 4), in registry with the flat top portion 31 of the feeder.

Construction and arrangement of apparatus thus far described is such that, using finger force to press the film down on flat top portion 31 of the feeder accessible through opening 35, in its left-hand or retracted position, shown in full lines in FIG. 4, the film and feeder 29 are moved forward in unison, as indicated by directional arrows in FIGS. 3 and 4, to the right-hand extended position shown in broken lines, to urge the film through slot 28. The film and feeder are then released, whereupon the feeder 29 alone springs back to its retracted or rest position, while the film remains extended so that a desired length may be pulled out by hand. Movements of feeder 29 are accommodated by flexure of arm 30, which conveniently may be formed of any one of a number of flexible and resilient sheet materials such as polystyrene, nylon, polypropylene, and the like. It may also comprise a spring biased pivotal arm of rigid material.

Further to the construction, a film cutter includes a cutting edge 36, for example a razor blade, carried by a bar 37 pivotally mounted at 38 on front wall 14 so that the cutting edge 36 will travel in a recessed slot or groove 39 (FIGS. 2 and 4) provided in the front edge of cover 16 and extending transversely of the film. Slot 39 is aligned with and faces the inner top edge of front wall 14. An operating handle 40 for cutter bar 37 projects through an arcuate slot 41, and construction and arrangement is such that grasping the extended film and folding it back over the cover, followed by grasping the cutter bar handle 40 and moving it from a rest position causes cutting edge 36, as is seen in broken lines in FIG. 2, to cut through the tape as it travels along the recessed slot 39. A coiled tension spring 42 (FIG. 2 only) extends between an anchor eyelet 43 on side wall 12 and an eyelet 44 on cutter bar 37, and is operative to return the bar to its rest position.

It will be appreciated that the disclosed apparatus is particularly advantageous in the dispensing and cutting of combination wax-rubber film compositions in tape form, and provided with an upwardly facing paper backing (not shown). For example, such a backing may be provided with printed lines or other indicia denoting predetermined lengths, and the lines may be readily and accurately aligned with the edge of cover 16 for cutting by blade 36 as it travels through slot 39 under the action of cutter bar 37. Moveover, the non-slippage characteristic of the film is overcome by the present dispenser through movement of the film and the feeder arm in unison in the dispensing direction.

While a preferred embodiment of the invention has been described, it will be understood that changes in form and materials may be restored to without departing from the scope of the appended claims.

I claim:

1. A dispensing apparatus for a roll package of sheet material, comprising: a container having side and bottom walls, and a cover affording access thereto; means for supporting a roll of sheet material within said container; means defining a slot between adjacent portions of said cover and one of said side walls, through which a free end portion of said sheet material may be fed from said roll; a feeder for said sheet material movable toward and away from said slot, biased toward said roll, and including an upper surface portion disposed for engagement with a lower surface of said sheet material; means defining an opening in said cover in registry with said upper surface portion of said feeder, the construction and arrangement being such that force applied to urge said sheet material against said upper surface of said feeder toward said slot is operative to move said feeder away from said roll toward said slot while feeding said sheet material from said roll through said slot, removal of said force permitting said feeder to move away from said slot, toward said roll; and means on said container for severing the portion of said sheet material fed through said slot, comprising means defining a recessed groove in said cover aligned with and facing the inner edge of said one side wall, and a cutter bar pivotal on said one side wall and including a cutting edge movable between a retracted position below said top edge, and to an extended position upon pivotation of said cutter bar, wherein said cutting edge moves within said groove to sever said sheet material extending transversely thereof and through said slot.

2. Apparatus of claim 1, wherein said feeder includes an arm of flexible and resilient material, said upper surface portion is supported on said arm, and recited movements thereof are afforded by flexure of said arm.

3. A dispensing apparatus for a roll package of sheet material, comprising: a generally box-shaped container including side, front, rear, and bottom walls and a removable cover mounted thereon for opening and closing the container; means in said container for supporting a roll of sheet material with its axis extending between and substantially perpendicular to the side walls; spacer means between said roll and said side walls for slightly compressing said roll to provide a drag thereon as it is unrolled; means defining an opening between said front wall and said cover through which a free end of said sheet material may extend; a pivotal feeder for said sheet material including an arm mounted on said bottom wall and biased toward said roll of sheet material, said arm including a substantially flat upper surface portion disposed for engagement with the lower surface of said free end portion of said sheet material; means defining an opening in said cover, in registry with said flat upper surface portion, the construction and arrangement being such that force applied to urge said sheet material against said flat upper surface portion, and the latter toward said forward opening, pivots said arm away from said roll toward said forward opening while moving said sheet material through said forward opening, release of said force permitting said arm to pivot rearwardly toward said roll; and means for severing the extended portion of said sheet material comprising a recessed slot in said cover aligned with and facing the inner top edge of said front wall, and a cutter bar pivotable on said front wall including a cutting edge, said bar being selectively pivotable to move said cutting edge between a retracted position below said inner top edge and an extended position wherein said cutting edge is moved within said slot to sever sheet material extending transversely thereof and through said forward opening.

4. Apparatus of claim 3, wherein said arm is of flexible and resilient material and its pivotation is afforded by flexure thereof.

5. Apparatus of claim 3 or 4 wherein said flat top surface portion includes a pair of laterally spaced projections positioned and adapted to project through said forward opening upon pivotation of said arm to move said sheet material through said forward opening.

6. Apparatus of claim 5, wherein said flat top surface portion projects rearwardly for engagement with said roll package, in provision of a predetermined rest position of said feeder in its recited biased disposition.

7. Apparatus according to claim 3 or 4, wherein said spacer means is adjustable in correspondence to predetermined different widths of roll packages.

8. A dispensing apparatus for a roll package of sheet material, comprising: a container having generally planar side and bottom walls, and a cover affording access thereto; means for supporting a roll of sheet material within said container; means defining a slot between adjacent portions of said cover and one of said walls through which a free end portion of said sheet material may be fed from said roll; means in said container operative to provide drag on said roll as sheet material is fed therefrom; a pivotal feeder for said sheet material including an arm mounted on said bottom wall, biased toward said roll, and pivotable toward and away from said slot, said arm including an upper surface portion disposed for engagement with a lower surface of said free end portion of said sheet material; means defining an opening in said cover in registry with said upper surface portion of said arm, the construction and arrangement being such that force applied to urge said sheet material against said upper surface portion of said arm, and the latter toward said slot, is operative to pivot said arm away from said roll toward said slot while feeding said sheet material from said roll through said slot, removal of said force permitting said arm to pivot rearwardly toward said roll; and means on said container for severing the portion of said sheet material fed through said slot comprising a recessed groove in said cover aligned with and facing the inner top edge of said one side wall, and a cutter bar pivotal on said one side wall and including a cutting edge movable between a retracted position below said top edge, and an extended position upon pivotation of said cutter bar wherein said cutting edge moves within said groove to sever sheet material extending transversely thereof and through said forward slot.

9. Apparatus of claim 8, wherein said arm is of flexible and resilient material and pivotation is afforded by flexure thereof.

10. Apparatus of claim 8 or 9 wherein said upper surface portion includes a pair of laterally spaced projections positioned and adapted to project through said slot upon pivotation of said arm to move said sheet material therethrough.

11. Apparatus of claim 10, wherein said upper surface portion projects rearwardly for engagement with said roll package in provision of a predetermined rest position of said feeder in its recited biased mode.

* * * * *